US009520009B2

(12) United States Patent
Wang

(10) Patent No.: US 9,520,009 B2
(45) Date of Patent: Dec. 13, 2016

(54) SCREEN UNLOCKING METHOD, APPARATUS, AND DEVICE

(71) Applicant: Huawei Technologies Co., Ltd., Shenzhen (CN)

(72) Inventor: Dedong Wang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 399 days.

(21) Appl. No.: 14/081,004

(22) Filed: Nov. 15, 2013

(65) Prior Publication Data

US 2014/0145821 A1 May 29, 2014

Related U.S. Application Data

(63) Continuation of application No. PCT/CN2013/073663, filed on Apr. 2, 2013.

(30) Foreign Application Priority Data

Nov. 29, 2012 (CN) ..... 2012 1 0499291

(51) Int. Cl.
*G07C 9/00* (2006.01)

(52) U.S. Cl.
CPC ..... *G07C 9/00142* (2013.01)

(58) Field of Classification Search
CPC ..... G07C 9/00142; G07C 9/0069; G07C 9/00182; G07C 9/00698; G07F 7/10
See application file for complete search history.

(56) References Cited

U.S. PATENT DOCUMENTS

2008/0076390 A1* 3/2008 Zhu ..... G06F 21/31 455/411
2010/0162182 A1* 6/2010 Oh ..... G06F 3/04883 715/863

(Continued)

FOREIGN PATENT DOCUMENTS

CN 101604223 A 12/2009
CN 101882046 A 11/2010

(Continued)

OTHER PUBLICATIONS

Partial English Translation and Abstract of Chinese Patent Application No. CN102236527A, Nov. 28, 2014, 29 pages.

(Continued)

*Primary Examiner* — Sisay Yacob
(74) *Attorney, Agent, or Firm* — Conley Rose, P.C.

(57) ABSTRACT

The present invention discloses a screen unlocking method, apparatus, and device, and relates to the field of touch control technologies, which can shorten the unlocking time and improve user experience. The method includes: displaying a screen unlocking interface which includes a password unlocking area and a shortcut unlocking area on a screen; receiving an unlocking pattern which includes a password unlocking pattern input through the password unlocking area and a shortcut unlocking pattern input through the shortcut unlocking area; determining whether the password unlocking pattern input by the user is consistent with a preset password unlocking pattern; and if the password unlocking pattern input by the user is consistent with the preset password unlocking pattern, unlocking the screen to enter a function interface corresponding to the shortcut unlocking pattern. The present invention is applicable to unlocking technologies of touch devices.

6 Claims, 9 Drawing Sheets

(56) References Cited

U.S. PATENT DOCUMENTS

| | | | | |
|---|---|---|---|---|
| 2010/0269040 | A1 | 10/2010 | Lee | |
| 2012/0053887 | A1 | 3/2012 | Nurmi | |
| 2013/0283212 | A1 | 10/2013 | Zhu et al. | |
| 2013/0298024 | A1* | 11/2013 | Rhee | G06F 3/0488 715/716 |

FOREIGN PATENT DOCUMENTS

| | | | |
|---|---|---|---|
| CN | 102075619 | A | 5/2011 |
| CN | 102130998 | A | 7/2011 |
| CN | 102236527 | A | 11/2011 |
| CN | 102402365 | A | 4/2012 |
| CN | 102609198 | A | 7/2012 |
| CN | 102624979 | A | 8/2012 |
| CN | 102693085 | A | 9/2012 |
| CN | 102779015 | A | 11/2012 |
| CN | 102799351 | A | 11/2012 |
| CN | 102968262 | A | 3/2013 |
| KR | 20100073743 | A | 7/2010 |
| KR | 20120079379 | A | 7/2012 |
| WO | 2010074468 | A2 | 7/2010 |
| WO | 2012093784 | A2 | 7/2012 |
| WO | 2013127233 | A1 | 9/2013 |

OTHER PUBLICATIONS

Foreign Communication From A Counterpart Application, Chinese Application No. 201210499291.4, Chinese Office Action dated Nov. 3, 2014, 8 pages.

Foreign Communication From A Counterpart Application, European Application No. 13779718.9, Extended European Search Report dated Oct. 31, 2014, 7 pages.

Foreign Communication From A Counterpart Application, PCT Application No. PCT/CN2013/073663, Chinese Search Report dated Sep. 5, 2013, 7 pages.

Foreign Communication From A Counterpart Application, PCT Application No. PCT/CN2013/073663, Chinese Written Opinion dated Sep. 5, 2013, 9 pages.

Foreign Communication From A Counterpart Application, Chinese Patent Application No. 201210499291.4, Chinese Office Action dated Jul. 10, 2015, 8 pages.

Foreign Communication From A Counterpart Application, Korean Application No. 10-2014-7017152, Korean Office Action dated Aug. 21, 2015, 7 pages.

Foreign Communication From A Counterpart Application, Korean Application No. 10-2014-7017152, English Translation of Korean Office Action dated Sep. 3, 2015, 9 pages.

* cited by examiner

SCREEN UNLOCKING METHOD, APPARATUS, AND DEVICE

CROSS-REFERENCE TO RELATED APPLICATIONS

This application is a continuation of International Application No. PCT/CN2013/073663, filed on Apr. 2, 2013, which claims priority to Chinese Patent Application No. 201210499291.4, filed on Nov. 29, 2012, both of which are hereby incorporated by reference in their entireties.

TECHNICAL FIELD

The present invention relates to the field of touch control technologies, and in particular, to a screen unlocking method, apparatus, and device.

BACKGROUND

A screen locking function is one of the major functions of a touch device. The application of the screen locking function brings about a lot of convenience to the life of users. When the touch device is in an idle or a not-in-use state, a user can lock the screen by using the screen locking function, which can save power consumption to prolong the standby time of the touch device, and prevent unexpected misoperations performed by the user on the touch device due to negligence when the touch device is in the idle or not-in-use state.

After the touch device enters a screen-locked state, the user is generally required to unlock the touch device to set the touch device to a working state. In the prior art, the user generally unlocks the touch device by using a finger or a stylus to slide on the touch display screen of the touch device. Currently, a touch device can generally provide two unlocking manners, which are specifically as follows:

The first manner is shortcut unlocking. After the user unlocks the touch device, the user directly enters a function interface corresponding to the shortcut.

The second manner is password pattern unlocking. After the user inputs a password pattern, the touch device verifies the password pattern input by the user; after the verification succeeds, the touch device is unlocked to enable the user to enter a home screen of the touch device.

The foregoing first unlocking manner enables the user to enter the function interface quickly, but the touch device does not authenticate the user identity, which leads to a defect in system security. The foregoing second unlocking can effectively ensure security, but the user can only enter the home screen of the touch device after the touch device is unlocked, and the user needs to perform a further interaction operation with the touch device to enter a desired function interface. As a result, the operations are complex and the unlocking time is long.

SUMMARY

The objective of embodiments of the present invention is to provide a screen unlocking method, apparatus, and device, which can save the unlocking time of a user, thereby improving user experience while effectively ensuring system security of a touch device.

In a first aspect of the present invention, a screen unlocking method is provided, where the method includes: displaying a screen unlocking interface on a screen, where the screen unlocking interface includes a password unlocking area and a shortcut unlocking area; receiving an unlocking pattern input by a user through the screen unlocking interface, where the unlocking pattern includes a password unlocking pattern input through the password unlocking area and a shortcut unlocking pattern input through the shortcut unlocking area; determining whether the password unlocking pattern input by the user is consistent with a preset password unlocking pattern; and if the password unlocking pattern input by the user is consistent with the preset password unlocking pattern, unlocking the screen to enter a function interface corresponding to the shortcut unlocking pattern.

In a first possible implementation manner of the first aspect, the password unlocking area is surrounded by the shortcut unlocking area, or, the shortcut unlocking area is surrounded by the password unlocking area, or, the password unlocking area and the shortcut unlocking area are adjacent in a vertical or horizontal distribution.

With reference to the first aspect or the first possible implementation manner of the first aspect, in a second possible implementation manner, on the screen unlocking interface, the password unlocking area includes at least two password buttons, where the at least two password buttons are distributed in a ring or arranged in an array.

With reference to the first aspect or the first possible implementation manner of the first aspect, in a third possible implementation manner, on the screen unlocking interface, the shortcut unlocking area includes at least two shortcut function buttons, where the at least two shortcut function buttons are distributed in a ring or arranged in an array.

With reference to the first aspect or the first possible implementation manner of the first aspect, in a fourth possible implementation manner, on the screen unlocking interface, the password unlocking area includes at least two password buttons, where the at least two password buttons are distributed in a ring or arranged in an array; and the shortcut unlocking area includes at least two shortcut function buttons, where the at least two shortcut function buttons are distributed in a ring or arranged in an array.

In a fifth possible implementation manner of the first aspect, the receiving an unlocking pattern input by a user through the screen unlocking interface specifically includes: receiving a password unlocking pattern input by the user in the password unlocking area; and receiving a shortcut unlocking pattern input by the user in the shortcut unlocking area, where the shortcut unlocking pattern is input by the user in the shortcut unlocking area after the user inputs the password unlocking pattern in the password unlocking area; or, receiving a shortcut unlocking pattern input by the user in the shortcut unlocking area; and receiving a password unlocking pattern input by the user in the password unlocking area, where the password unlocking pattern is input by the user in the password unlocking area after the user inputs the shortcut unlocking pattern in the shortcut unlocking area.

In a sixth possible implementation manner of the first aspect, the receiving an unlocking pattern input by a user through the screen unlocking interface specifically includes: receiving an unlocking pattern input by the user by sliding in the password unlocking area; detecting, according to the unlocking pattern input by the user by sliding in the password unlocking area, the password unlocking pattern input by the user; receiving an unlocking pattern which is input by the user by sliding in the shortcut unlocking area after the user slides away from the password unlocking area; and detecting, according to the unlocking pattern input by the user by sliding in the shortcut unlocking area, the shortcut unlocking pattern input by the user; where, the determining whether the password unlocking pattern input by the user is consistent with a preset password unlocking pattern specifically includes: determining whether the detected password unlocking pattern input by the user is consistent with the preset password unlocking pattern; and the unlocking the screen to enter a function interface corresponding to the shortcut unlocking pattern specifically includes: unlocking the screen to enter a function interface corresponding to the detected shortcut unlocking pattern.

With reference to the first aspect or any implementation manner of the foregoing possible implementation manners of the first aspect, in a seventh possible implementation manner of the first aspect, after the determining whether the password unlocking pattern input by the user is consistent with a preset password unlocking pattern, the method further includes: if the password unlocking pattern input by the user is inconsistent with the preset password unlocking pattern, sending a password incorrect prompt to the user.

In a second aspect of the present invention, a screen unlocking apparatus is provided, where the apparatus includes: a displaying unit, configured to display a screen unlocking interface on a screen, where the screen unlocking interface includes a password unlocking area and a shortcut unlocking area; a receiving unit, configured to receive an unlocking pattern input by a user through the screen unlocking interface displayed by the displaying unit, where the unlocking pattern includes a password unlocking pattern input through the password unlocking area and a shortcut unlocking pattern input through the shortcut unlocking area; a password determining unit, configured to determine whether the password unlocking pattern which is input by the user and received by the receiving unit is consistent with a preset password unlocking pattern; and an unlocking unit, configured to: if the password determining unit determines that the password unlocking pattern input by the user is consistent with the preset password unlocking pattern, unlock the screen to enter a function interface corresponding to the shortcut unlocking pattern.

In a first possible implementation manner of the second aspect, on the screen unlocking interface displayed by the displaying unit, the password unlocking area is surrounded by the shortcut unlocking area, or, the shortcut unlocking area is surrounded by the password unlocking area, or, the password unlocking area and the shortcut unlocking area are adjacent in a vertical or horizontal distribution.

With reference to the second aspect or the first possible implementation manner of the second aspect, in a second possible implementation manner, on the screen unlocking interface, the password unlocking area includes at least two password buttons, where the at least two password buttons are distributed in a ring or arranged in an array.

With reference to the second aspect or the first possible implementation manner of the second aspect, in a third possible implementation manner, on the screen unlocking interface displayed by the displaying unit, the shortcut unlocking area includes at least two shortcut function buttons, where the at least two shortcut function buttons are distributed in a ring or arranged in an array.

With reference to the second aspect or the first possible implementation manner of the second aspect, in a fourth possible implementation manner, on the screen unlocking interface displayed by the displaying unit, the password unlocking area includes at least two password buttons, where the at least two password buttons are distributed in a ring or arranged in an array; and the shortcut unlocking area includes at least two shortcut function buttons, where the at least two shortcut function buttons are distributed in a ring or arranged in an array.

In a fifth possible implementation manner of the second aspect, the receiving unit is specifically configured to: receive an unlocking pattern input by the user in the password unlocking area, where the unlocking pattern includes the password unlocking pattern; and receive the shortcut unlocking pattern input by the user in the shortcut unlocking area, where the shortcut unlocking pattern is input by the user in the shortcut unlocking area after the user inputs the password unlocking pattern in the password unlocking area; or, receive the shortcut unlocking pattern input by the user in the shortcut unlocking area; and receive the password unlocking pattern input by the user in the password unlocking area, where the password unlocking pattern is input by the user in the password unlocking area after the user inputs the shortcut unlocking pattern in the shortcut unlocking area.

In a sixth possible implementation manner of the second aspect, the receiving unit specifically includes: a receiving module, configured to receive an unlocking pattern input by the user by sliding in the password unlocking area; and a detecting module, configured to detect, according to the unlocking pattern input by the user by sliding in the password unlocking area, the password unlocking pattern input by the user; where, the receiving module is further configured to receive an unlocking pattern which is input by the user by sliding in the shortcut unlocking area after the user slides away from the password unlocking area; and the detecting module is further configured to detect, according to the unlocking pattern input by the user by sliding in the shortcut unlocking area, the shortcut unlocking pattern input by the user; the password determining unit is specifically configured to determine whether the password unlocking pattern which is input by the user and detected by the detecting unit is consistent with the preset password unlocking pattern; and the unlocking unit is specifically configured to unlock the screen to enter a function interface corresponding to the shortcut unlocking pattern detected by the detecting module.

With reference to the second aspect or any implementation manner of the foregoing possible implementation manners of the second aspect, in a seventh possible implementation manner of the second aspect, the apparatus further includes: a prompting unit, configured to: if the password unlocking pattern input by the user is inconsistent with the preset password unlocking pattern, send a password incorrect prompt to the user.

In a third aspect of the present invention, a touch device is provided, where the touch device includes: a case, a circuit board, a touch display screen, a processor, a memory, and a power supply circuit, where the touch display screen is arranged on the case, the circuit board is arranged in space enclosed by the case, and the processor and the memory are disposed on the circuit board; the memory is configured to store data; the power supply circuit is configured to supply power to circuits or components of the touch device; and the processor is configured to process data and is specifically configured to: display a screen unlocking interface on the touch display screen, where the screen unlocking interface includes a password unlocking area and a shortcut unlocking area; receive an unlocking pattern input by a user through the screen unlocking interface of the touch display screen, where the unlocking pattern includes a password unlocking pattern input through the password unlocking area and a shortcut unlocking pattern input through the shortcut unlocking area; determine whether the password unlocking pattern input by the user is consistent with a preset password unlocking pattern; and if the password unlocking pattern input by the user is consistent with the preset password unlocking pattern, unlock the screen to enter a function interface corresponding to the shortcut unlocking pattern.

In a first possible implementation manner of the third aspect, on the screen unlocking interface displayed by the touch display screen, the password unlocking area is surrounded by the shortcut unlocking area, or, the shortcut unlocking area is surrounded by the password unlocking area, or, the password unlocking area and the shortcut unlocking area are adjacent in a vertical or horizontal distribution.

With reference to the third aspect or the first possible implementation manner of the third aspect, in a second possible implementation manner of the third aspect, the password unlocking area displayed by the touch display screen includes at least two password buttons, where the at least two password buttons are distributed in a ring or arranged in an array.

With reference to the third aspect or the first possible implementation manner of the third aspect, in a third possible implementation manner of the third aspect, the shortcut unlocking area displayed by the touch display screen includes at least two shortcut function buttons, where the at least two shortcut function buttons are distributed in a ring or arranged in an array.

With reference to the third aspect or the first possible implementation manner of the third aspect, in a fourth possible implementation manner of the third aspect, the password unlocking area displayed by the touch display screen includes at least two password buttons, where the at least two password buttons are distributed in a ring or arranged in an array; and the shortcut unlocking area displayed by the touch display screen includes at least two shortcut function buttons, where the at least two shortcut function buttons are distributed in a ring or arranged in an array.

With reference to the third aspect or any implementation manner of the foregoing possible implementation manners of the third aspect, in a fifth possible implementation manner of the third aspect, the touch device includes a handset, a tablet computer or a personal digital assistant.

In the screen unlocking method, apparatus, and device provided in the embodiments of the present invention, a screen unlocking interface includes both a password unlocking area and a shortcut unlocking area; and password unlocking and shortcut unlocking are performed by receiving unlocking patterns input by a user in the foregoing two areas, respectively. Therefore, through a screen unlocking interface, the user can perform not only password unlocking but also shortcut unlocking, where the password unlocking can effectively ensure the system security of a touch device and the shortcut unlocking enables the user to enter a desired function interface quickly. Therefore, the user performs both password unlocking and shortcut unlocking by interacting with the touch device only once, which effectively shortens the unlocking time of the user. In addition, the operation is convenient, thereby effectively improving user experience.

BRIEF DESCRIPTION OF DRAWINGS

To illustrate the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
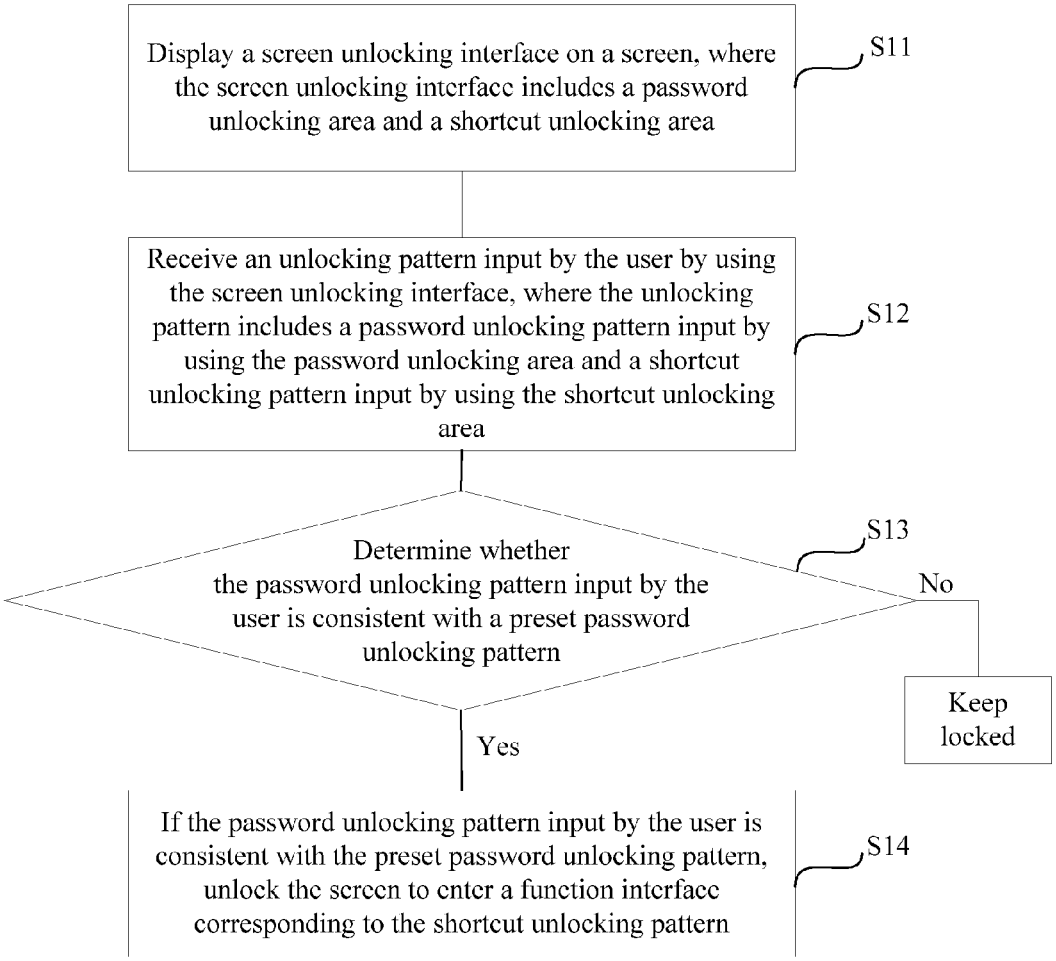
FIG. 1 is a schematic flowchart of a screen unlocking method according to an embodiment of the present invention.

An embodiment of the present invention provides a screen unlocking method, where the screen unlocking method is executed by a touch device, and specifically by a screen unlocking apparatus disposed in the touch device. As shown in FIG. 1, the screen unlocking method includes the following steps:

S11. Display a screen unlocking interface on a screen, where the screen unlocking interface includes a password unlocking area and a shortcut unlocking area.

Assuming that the touch device is a handset, when the handset is in a dormant state or a standby state, if a power button or a function button used for unlocking is pressed, a screen unlocking interface is displayed on the handset screen.

In this step, the screen unlocking interface provided by the touch device includes a password unlocking area and a shortcut unlocking area. The password unlocking area is used to receive a password unlocking pattern input by a user to perform password unlocking, where the password unlocking refers to the process in which the user inputs, through the password unlocking area, a password pattern (also called password) for unlocking; the touch device verifies whether the password pattern input by the user is consistent with a password pattern which is preset by the user by using the touch device; if the password pattern input by the user is consistent with the preset password pattern, the touch device is unlocked; otherwise, the touch device keeps a screen-locked state. The password unlocking can effectively ensure system security of the touch device. The shortcut unlocking area is used to receive a shortcut unlocking pattern input by the user to perform shortcut unlocking, where the shortcut unlocking refers to the process in which the user selects a shortcut and the touch device activates a function corresponding to the shortcut selected by the user. The shortcut unlocking enables the user to enter a desired function interface quickly.

It should be particularly noted that in the embodiment of the present invention, the screen unlocking interface provided by the touch device includes both a password unlocking area and a shortcut unlocking area. Therefore, the user can perform password unlocking and shortcut unlocking through only one screen unlocking interface, that is, the user can complete the foregoing two types of unlocking by interacting with the touch device only once, instead of interacting with the touch device multiple times, which enables the user to enter a desired function interface quickly, thereby shortening the unlocking time of the user. In addition, the password unlocking effectively ensures system security of the touch device, thereby effectively improving user experience.

For example, on the screen unlocking interface, positional relationships between the password unlocking area and the shortcut unlocking area may include the following three types:

First, on the screen unlocking interface, the password unlocking area may be surrounded by the shortcut unlocking area. For example, the password unlocking area is located at the center of the screen of the touch device, while the shortcut unlocking area is set around the password unlocking area. For details about this type of positional relationship, reference may be made to a screen unlocking interface illustrated in FIG. 2.

Figure 3:
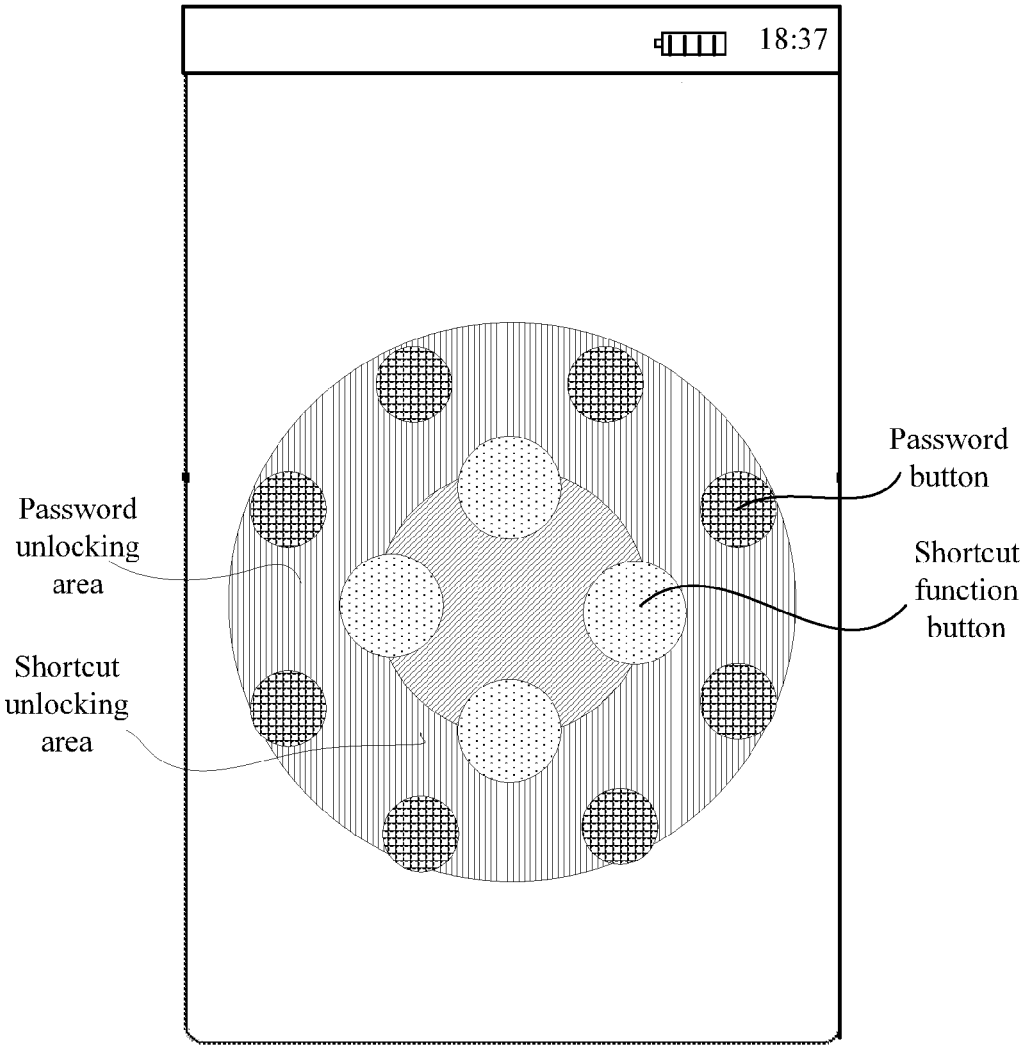
FIG. 3 is another exemplary schematic diagram of a screen unlocking interface in the screen unlocking method illustrated in FIG. 1.

Second, with reference to a screen unlocking interface illustrated in FIG. 3, on the screen unlocking interface, the shortcut unlocking area may be surrounded by the password unlocking area. For example, the shortcut unlocking area is located at the center of the screen of the touch device, while the password unlocking area is set around the shortcut unlocking area.

Figure 4:
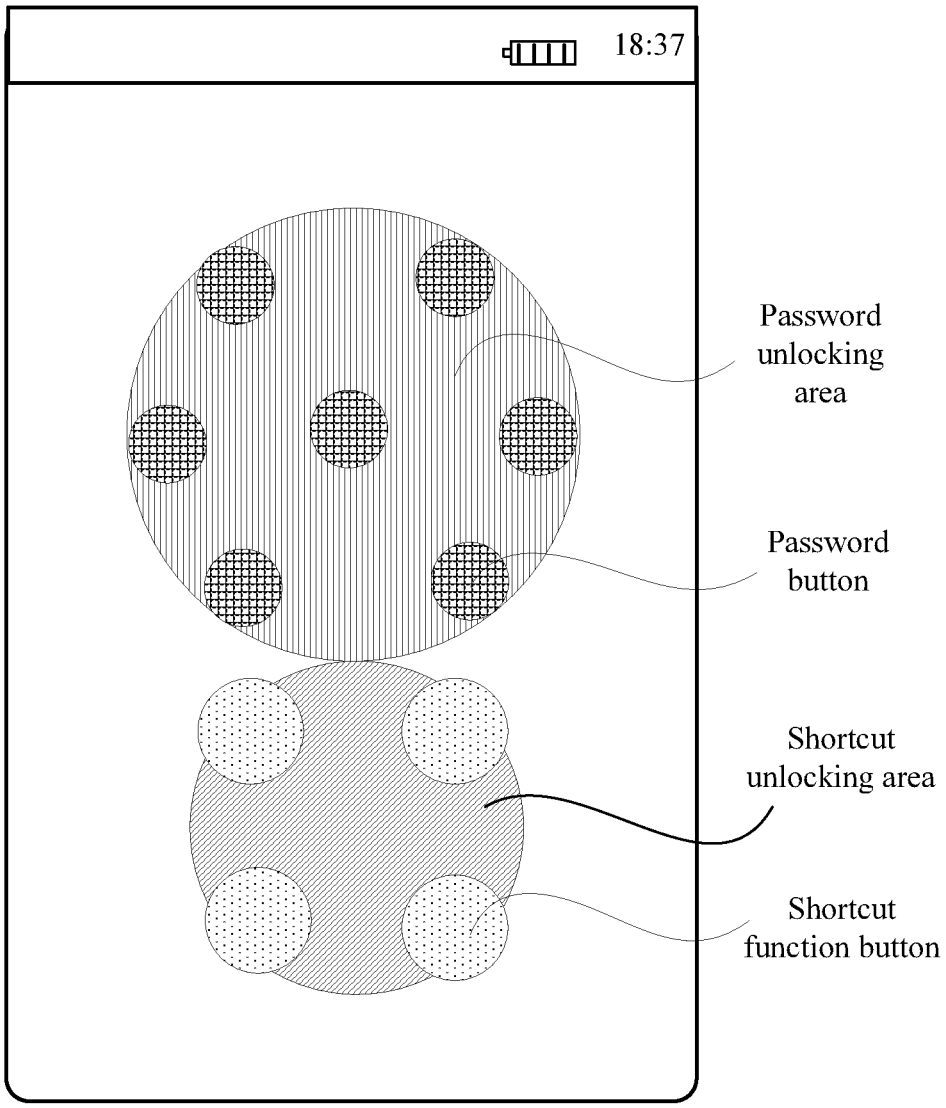
FIG. 4 is another exemplary schematic diagram of a screen unlocking interface in the screen unlocking method illustrated in FIG. 1.

Third, with reference to a screen unlocking interface illustrated in FIG. 4, on the screen unlocking interface, the password unlocking area and the shortcut unlocking area may also be adjacent in a vertical distribution. For example, the shortcut unlocking area is located at a lower part of the screen of the touch device, while the password unlocking area is located above the shortcut unlocking area.

Definitely, the password unlocking area and the shortcut unlocking area may also be adjacent in a horizontal distribution.

It should be noted that, in this distribution manner, of the password unlocking area and the shortcut unlocking area, which area is on the left and which area is on the right, or which area is upper and which area is lower are not limited in the present invention. In addition, in this manner, the foregoing two unlocking areas are not limited to an aligned arrangement, and the two areas may be unaligned. For example, the password unlocking area is located at a lower left corner of the screen, while the shortcut unlocking area is located at an upper right corner of the screen.

It should be noted that, in the embodiment of the present invention, on the screen unlocking interface, the password unlocking area may be distinguished from the shortcut unlocking area by using a color, a frame, or a boundary line. For example, the foregoing two unlocking areas are filled with different colors, the foregoing two unlocking areas are delineated by using their respective frames, and/or a boundary line is set between the foregoing two unlocking areas. How to distinguish the password unlocking area from the shortcut unlocking area on the screen unlocking interface is not limited in the present invention, and may be set by a person skilled in the art freely.

It may be understood that, although the screen unlocking interface displayed in this step includes a password unlocking area and a shortcut unlocking area, there may be no obvious difference between the two unlocking areas. As long as a screen unlocking interface includes an area where the user performs password unlocking and an area where the user performs shortcut unlocking, the screen unlocking interface can be considered to include a password unlocking area and a shortcut unlocking area, no matter how these two areas are distributed. For example, on the screen unlocking interface, the password unlocking area and the shortcut unlocking area may be combined into one area, that is, the user can perform password unlocking and shortcut unlocking through one area only, and this area may be considered to be the password unlocking area and the shortcut unlocking area.

Specifically, in the embodiment of the present invention, on the screen unlocking interface, the shape of the password unlocking area is not limited, and the password unlocking area may be designed into any shape. For example, the password unlocking area may be designed into a circle or a regular or irregular polygon. Similarly, the shape of the shortcut unlocking area is not limited, and the shortcut unlocking area may be designed into any shape. For example, the shortcut unlocking area may be designed into a circle or a regular or irregular polygon.

Figure 2:
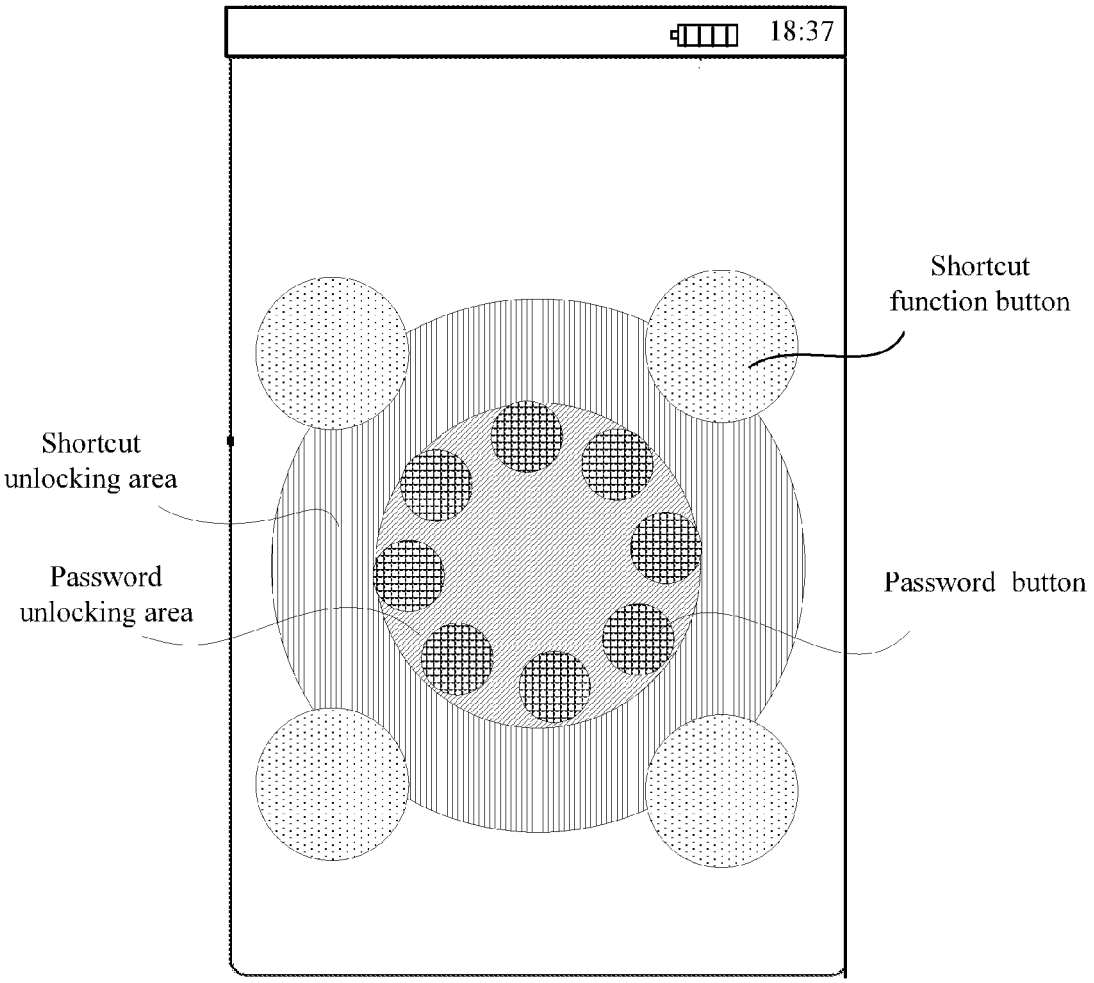
FIG. 2 is an exemplary schematic diagram of a screen unlocking interface in the screen unlocking method illustrated in FIG. 1.

In an embodiment of the present invention, for example, reference may be made to the screen unlocking interface illustrated in any one of FIG. 2 to FIG. 4, the password unlocking area may include at least two password buttons, and a user may input an unlocking password by pressing or sliding over these buttons according to a specific rule. For example, these buttons may be distributed in a ring or be arranged in an array or be arranged at random, where each password unlocking button may be designed into a circle, a quadrilateral, or other regular polygons or irregular polygons, and the password unlocking buttons may be designed into the same shape or different shapes. Optionally, characters such as numbers and letters, or graphics, for example, flower graphics, imitative emotion graphics, and the like, may be set on the password unlocking buttons.

In an embodiment of the present invention, for example, reference may be made to the screen unlocking interface illustrated in any one of FIG. 2 to FIG. 4, a shortcut unlocking area may include at least two shortcut function buttons; and a user may perform shortcut unlocking by selectively pressing or sliding over a shortcut function button, so that the touch device enters a function interface corresponding to the shortcut function button. For example, these buttons may be distributed in a ring or be arranged in an array or be arranged at random, where each shortcut function button may be designed into a circle, a quadrilateral, or other regular polygons or irregular polygons, and the shortcut function buttons may be designed into the same shape or different shapes. On each shortcut function button, a function description or an icon corresponding to a function is set. For example, the shortcut unlocking area includes four shortcut function buttons, where, function descriptions, namely, "short message", "telephone book", "dialer", and "music player", are set on the four shortcut function buttons, or icons corresponding to the foregoing four functions are disposed respectively on the four shortcut function buttons.

It should be noted that the setting of password unlocking buttons or the setting of shortcut function buttons is not limited in the present invention. For example, the password unlocking buttons and the shortcut function buttons may be set in, but not limited to, the foregoing distribution manners. In addition, the password unlocking buttons and the shortcut function buttons may be designed into any shape.

To help understanding, the following describes the screen unlocking interface displayed by the touch device in this step by using examples. It may be understood that the following example is used only for the purpose of description and not intended to limit the present invention.

FIG. 2 is an exemplary schematic diagram of the screen unlocking interface displayed by the touch device in this step. As shown in FIG. 2, in this example, the password unlocking area is surrounded by the shortcut unlocking area; the password unlocking area is designed into a circle, in which eight circular password unlocking buttons are distributed, where the eight circular password unlocking buttons are distributed in a ring; the shortcut unlocking area is distributed on the periphery of the password unlocking area and is concentric with the password unlocking area; four circular shortcut function buttons are distributed in an upper part and a lower part of the shortcut unlocking area, where icons (not illustrated) corresponding to functions, for example, icons corresponding to such functions as "camera", "telephone dialer", "short message", and "music player", are set on the shortcut function buttons.

Figure 5:
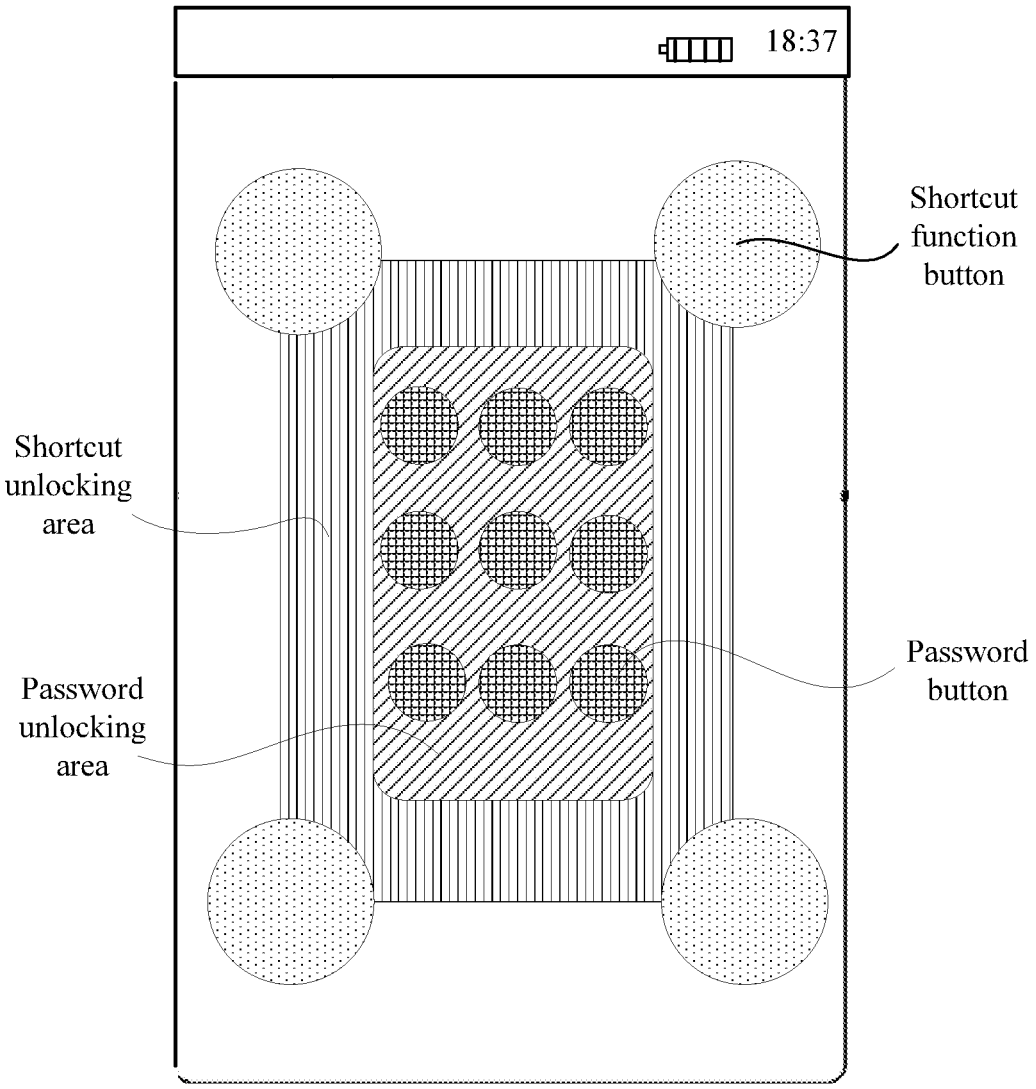
FIG. 5 is another exemplary schematic diagram of a screen unlocking interface in the screen unlocking method illustrated in FIG. 1.

FIG. 5 is another exemplary schematic diagram of the screen unlocking interface displayed by the touch device in this step. As shown in FIG. 5, in this example, the password unlocking area is surrounded by the shortcut unlocking area; the password unlocking area is designed into a rectangle, where nine circular password unlocking buttons are distributed, where the nine password unlocking buttons are distributed in an array; the shortcut unlocking area is distributed on the periphery of the password unlocking area and is also designed into a rectangle; four circular shortcut function buttons are distributed at the upper vertex angles and lower vertex angles of the shortcut unlocking area, where icons (not illustrated) corresponding to functions, for example, icons corresponding to such functions as "camera", "telephone dialer", "short message", and "music player", are set on the four shortcut function buttons.

Figure 6:
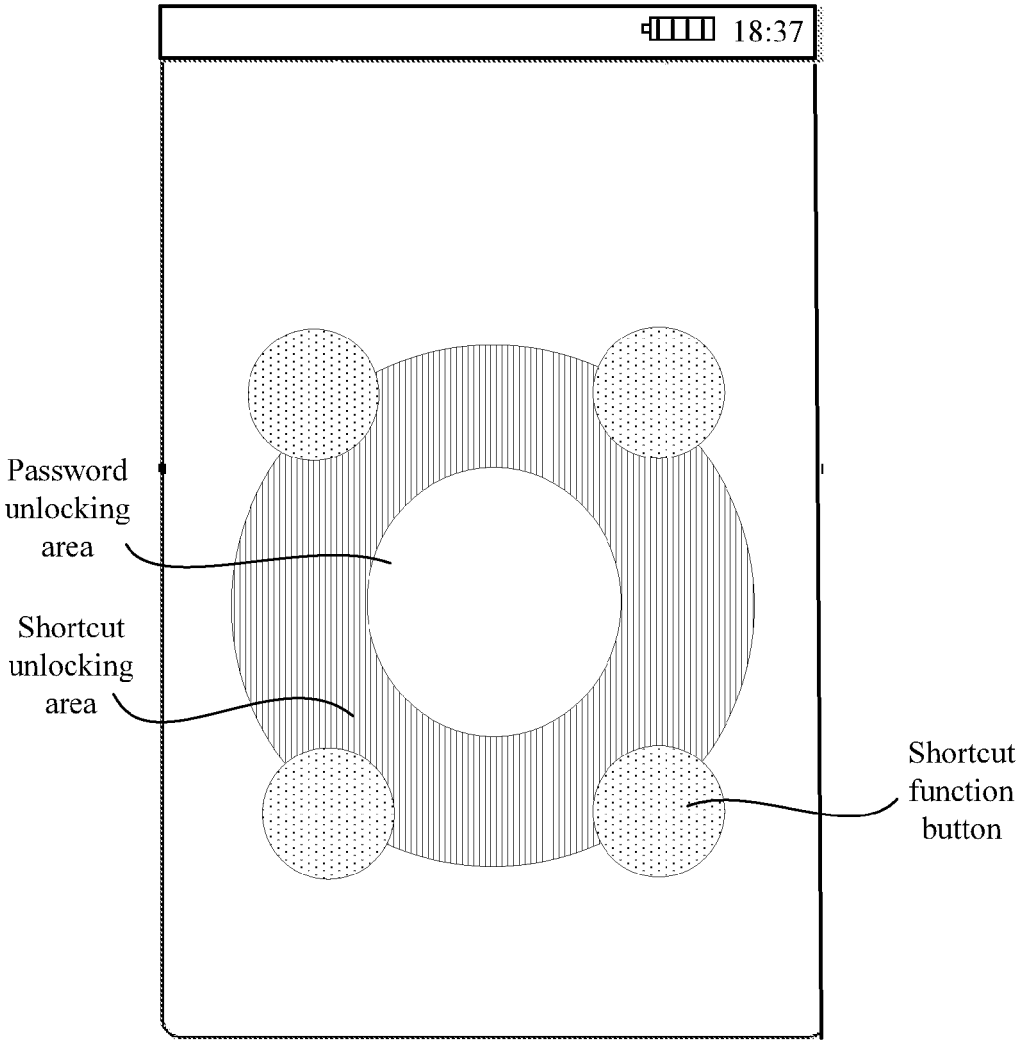
FIG. 6 is another exemplary schematic diagram of a screen unlocking interface in the screen unlocking method illustrated in FIG. 1.

It should be noted that, alternatively, the password unlocking area may include no password unlocking button and is a blank area only. The user may input, through the blank area, a character or a pattern as a password to perform unlocking. For example, in another example of the screen unlocking interface displayed by the touch device in this step, as shown in FIG. 6, the password unlocking area is surrounded by the shortcut unlocking area; the password unlocking area is a circular blank area, and the shortcut unlocking area is concentric with the password unlocking area; four circular shortcut function buttons are distributed in the shortcut unlocking area, where icons (not illustrated) corresponding to functions, for example, icons corresponding to such functions as "camera", "telephone dialer", "short message", and "music player", are set on the shortcut function buttons.

It should be noted that for a small-sized device screen, for example, a handset screen, if the password unlocking area is surrounded by the shortcut unlocking area and the password unlocking area is not large enough, the user will easily slide out of the password unlocking area when inputting an unlocking password, causing inconvenience. In addition, if the password buttons in the password unlocking area are not far enough from the shortcut function buttons, misoperations may also be caused. Therefore, the size of the password unlocking area and the upper limit of the number of password buttons included in the password unlocking area, and the size of the shortcut unlocking area and the upper limit of the number of shortcut function buttons included in the shortcut unlocking area are not limited in the present invention, and a proper adjustment may be made according to the size of the screen of the touch device and user satisfaction.

It can be seen from the above that the password unlocking area on the screen unlocking interface is used to input a password and further authenticate the user identity, and the shortcut unlocking area on the screen unlocking interface is used to perform shortcut unlocking and activate corresponding functions. Pattern password unlocking and shortcut unlocking are performed on one interface, which reduces the waiting time of the user, and increases efficiency, thereby effectively improving user experience.

S12. Receive an unlocking pattern input by the user through the screen unlocking interface, where the unlocking pattern includes a password unlocking pattern input through the password unlocking area and a shortcut unlocking pattern input through the shortcut unlocking area.

After the screen unlocking interface is displayed on the screen of the touch device, the user slides to input a pattern on the unlocking interface by using a finger or a stylus to perform password unlocking and shortcut unlocking.

In this step, the user inputs an unlocking pattern through the screen unlocking interface, where the unlocking pattern refers to all patterns that the user inputs by sliding on the screen unlocking interface when performing screen unlocking. However, it may be understood that the password unlocking needs the input of a password unlocking pattern and the shortcut unlocking needs the input of a shortcut unlocking pattern, while in the embodiment of the present invention, the foregoing two areas are located on the same screen unlocking interface, and therefore the process where the user performs password unlocking and shortcut unlocking is a successive process performed on one screen unlocking interface, that is, it may be understood that the password pattern input by the user is actually an unlocking pattern that includes the password unlocking pattern and the shortcut unlocking pattern. The password unlocking pattern is a part of the unlocking pattern input by the user and used to perform password unlocking, while the shortcut unlocking pattern is a part of the unlocking pattern input by the user and used to perform shortcut unlocking.

In the embodiment of the present invention, the sequence of inputting patterns by the user is not limited. The user may first input the password unlocking pattern in the password unlocking area, and then enter the shortcut unlocking area to input the shortcut unlocking pattern, or the user may first input the shortcut unlocking pattern, and then enter the password unlocking area to input the password unlocking pattern. That is, in this step, the touch device may first receive the password unlocking pattern input by the user in the password unlocking area, and then receive the shortcut unlocking pattern which is input by the user in the shortcut unlocking area after the user inputs the password unlocking pattern in the password unlocking area; or, the touch device may first receive the shortcut unlocking pattern input by the user in the shortcut unlocking area, and then receive the password unlocking pattern which is input by the user in the password unlocking area after the user inputs the shortcut unlocking pattern in the shortcut unlocking area.

It may be understood that when the user performs screen unlocking through an unlocking interface, that is, when the user slides to input an unlocking pattern by using a stylus or a finger, the user generally does not raise the finger or the stylus in this process, but after completing the sliding over one area of the password unlocking area and the shortcut unlocking area, the user slides away from the area, and then enters the other area of the two areas until the whole unlocking pattern is input by sliding, that is, no matter whether the user first inputs the password unlocking pattern or first inputs the shortcut unlocking pattern, the two patterns may be successive and uninterrupted, that is, the password unlocking pattern and the shortcut unlocking pattern received by the touch device may be successive and uninterrupted.

It should be noted that, in an embodiment of the present invention, the password unlocking pattern and the shortcut unlocking pattern input by the user may also be combined into one pattern, that is, the user needs only to input one pattern to perform both password unlocking and shortcut unlocking. For example, the user presses and holds a shortcut button and drags the shortcut button regularly according to a preset password unlocking pattern, so that the user performs both the password unlocking and the shortcut unlocking.

It may be further understood that, in this step, in addition to the password unlocking pattern and the shortcut unlocking pattern, the unlocking pattern input by the user may further include other patterns, for example, lines connecting the password unlocking pattern and the shortcut unlocking pattern, and other patterns input freely by the user. Therefore, in this step, when receiving the unlocking pattern input by the user, the touch device needs to detect the password unlocking pattern and the shortcut unlocking pattern from the unlocking pattern input by the user.

S13. Determine whether the password unlocking pattern input by the user is consistent with a preset password unlocking pattern.

To effectively ensure system security of the touch device, a main user of the touch device presets a password unlocking pattern in the touch device; if the main user or another user needs to perform screen unlocking to use the touch device, the unlocking succeeds only when the password unlocking pattern input by the main user or the another user is consistent with the password unlocking pattern preset by the main user; and if the password unlocking pattern input by the main user or the another user is inconsistent with the preset password unlocking pattern, the unlocking fails, thereby effectively ensuring the system security.

In this step, specifically, the touch device compares the detected password unlocking pattern with a preset password pattern to determine whether the detected password unlocking pattern is consistent with the preset password pattern.

S14. If the password unlocking pattern input by the user is consistent with the preset password unlocking pattern, unlock the screen to enter a function interface corresponding to the shortcut unlocking pattern.

In this step, when the password unlocking pattern input by the user is consistent with the preset password unlocking pattern, the touch device enters a function interface corresponding to the shortcut unlocking pattern input by the user. For example, if the user selects a "dialer" shortcut by using the shortcut unlocking pattern, in this step, when the password unlocking pattern input by the user is consistent with the preset password unlocking pattern, the touch device enters the "dialer" interface.

Alternatively, if the detected password unlocking pattern input by the user is inconsistent with the preset password unlocking pattern, the touch device keeps the locking state unchanged, and may send a password incorrect prompt to the user. The password incorrect prompt includes an icon prompt and/or a sound prompt, for example, a "password incorrect" dialog box displayed on the screen interface, or a "password incorrect" sound prompt.

It should be noted that, if the user only inputs the password unlocking pattern in the password unlocking area but does not enter the shortcut unlocking area to input the shortcut unlocking pattern, that is, the user does not select any shortcut and the touch device detects the password unlocking pattern only, the touch device considers by default that the shortcut unlocking pattern is null. In a case where the shortcut unlocking pattern is null, after confirming the password pattern subsequently, the touch device may directly enter the home screen or enter a default function interface.

In the screen unlocking method provided in the embodiment of the present invention, a screen unlocking interface is displayed on a screen, where the screen unlocking interface includes a password unlocking area and a shortcut unlocking area; an unlocking pattern input by a user through the screen unlocking interface is received, where the unlocking pattern includes a password unlocking pattern input through the password unlocking area and a shortcut unlocking pattern input through the shortcut unlocking area; then, it is determined whether the password unlocking pattern input by the user is consistent with a preset password unlocking pattern; and if the password unlocking pattern input by the user is consistent with the preset password unlocking pattern, the screen is unlocked to enter a function interface corresponding to the shortcut unlocking pattern. It can be seen from the above that pattern password unlocking and shortcut unlocking can be completed on one interface through one interaction, which not only enhances the security of the touch device but also helps the user to enter a specific function quickly, thereby reducing the waiting time of the user, increasing efficiency, and effectively improving user experience.

To help a person skilled in the part to better understand the technical solution of the screen unlocking method provided in the embodiment of the present invention, the screen unlocking method provided by the present invention is described in the following in detail with reference to specific embodiments.

Figure 7:
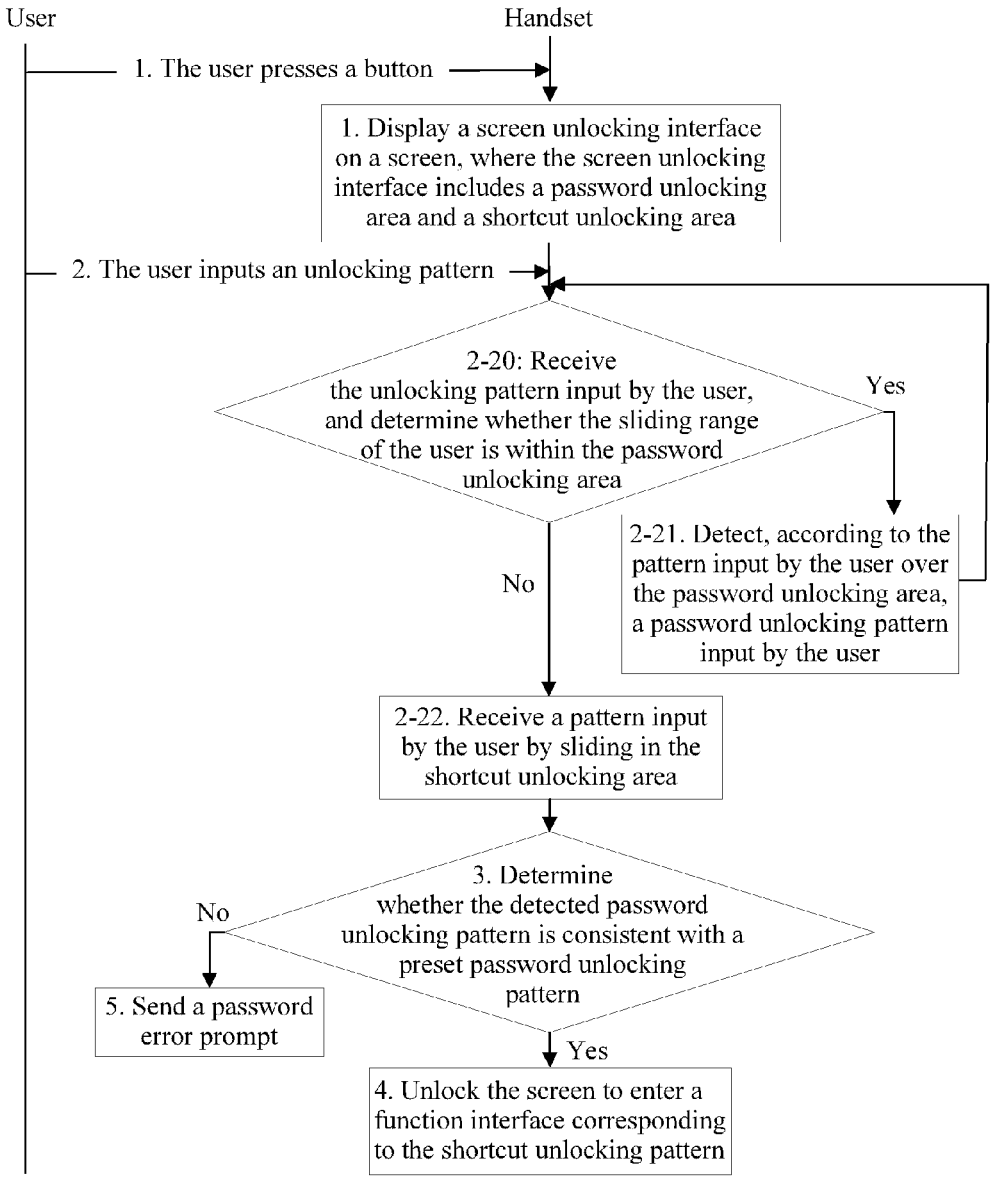
FIG. 7 is another schematic flowchart of a screen unlocking method according to an embodiment of the present invention.

This embodiment assumes that the touch device is a handset. As shown in FIG. 7, a screen unlocking method provided in this embodiment includes the following steps:

1. A user presses a power button of a handset in a locked state, and the handset lightens a touch display screen, and displays a screen unlocking interface on the touch display screen.

Specifically, in this step, the screen unlocking interface is described through the screen unlocking interface illustrated in FIG. 2 as an example; the screen unlocking interface includes a password unlocking area and a shortcut unlocking interface, where the password unlocking area is surrounded by the shortcut unlocking area; the password unlocking area is designed into a circle, in which eight circular password unlocking buttons are distributed, where the eight password unlocking buttons are distributed in a ring; the shortcut unlocking area is distributed on the periphery of the password unlocking area and is concentric with the password unlocking area; four circular shortcut function buttons are distributed at an upper part and a lower part of the shortcut unlocking area, where icons (not illustrated) corresponding to functions, for example, icons corresponding to such functions as "camera", "telephone dialer", "short message", and "music player", are set on the shortcut function buttons.

It may be understood that this embodiment is described only through the screen unlocking interface illustrated in FIG. 2 as an example, but the screen unlocking interface provided in this embodiment is not limited to the screen unlocking interface illustrated in FIG. 2.

2. The user slides on the screen unlocking interface to input an unlocking pattern, and the handset receives the unlocking pattern input by the user.

In this embodiment, the user first inputs a password unlocking pattern in the password unlocking area, and then enters the shortcut unlocking area to input a shortcut unlocking pattern, that is, the handset first receives the password unlocking pattern, and then receives the shortcut unlocking pattern. Definitely, the handset may also first receive the shortcut unlocking pattern, and then receive the password unlocking pattern, which is not further described herein.

In this step, the user begins to slide gestures on the screen unlocking interface to input a password unlocking pattern and a shortcut unlocking pattern successively; when the user slides gestures, the handset receives the unlocking patterns input by the user.

Specifically, in this step of this embodiment, the handset may mainly perform the following detailed steps:

20. The handset receives an unlocking pattern input by the user by sliding in the password unlocking area, and determines whether the sliding range of the user is within the password unlocking area.

If the sliding range of the user is within the password unlocking area, the handset considers that the user slides in the password unlocking area, and step 21 is performed; if the sliding range of the user is beyond the password unlocking area, the handset considers that the user slides away from the password unlocking area, and step 22 is performed.

21. The handset detects, according to the pattern input by the user by sliding in the password unlocking area, the password unlocking pattern input by the user.

22. The handset controls all the password unlocking buttons to become invalid, and stops detection of a password unlocking pattern; and receives a pattern input by the user by sliding in the shortcut unlocking area, and detects, according to the pattern input by the user by sliding in the shortcut unlocking area, whether the user slides to a specific shortcut function button and ends the sliding, that is, detects whether the user completes inputting the shortcut unlocking pattern; if yes, the handset considers that the user selects a function corresponding to the specific shortcut function button, and performs a subsequent password check process; otherwise, the handset continues the detection until it detects that the user slides to a specific shortcut function button and ends the sliding.

3. The handset determines whether the password unlocking pattern detected by the handset is consistent with a preset password unlocking pattern.

If the password unlocking pattern detected by the handset is consistent with the preset password unlocking pattern, step 4 is performed; and if the detected password unlocking pattern input by the user is inconsistent with the preset password unlocking pattern, step 5 is performed.

4. The handset unlocks the screen to enter a function interface corresponding to the detected specific shortcut function button.

5. The handset sends a password incorrect prompt to the user.

In the screen unlocking method provided in this embodiment, a screen unlocking interface includes both a password unlocking area and a shortcut unlocking area; and password unlocking and shortcut unlocking are performed by receiving unlocking patterns input by a user in the foregoing two areas, respectively. Therefore, through a screen unlocking interface, the user can perform not only password unlocking but also shortcut unlocking, where the password unlocking can effectively ensure the system security of a touch device and the shortcut unlocking enables the user to enter a desired function interface quickly. Therefore, the user performs both password unlocking and shortcut unlocking by interacting with the touch device only once, which effectively shortens the unlocking time of the user. In addition, the operation is convenient, thereby effectively improving user experience.

Figure 8:
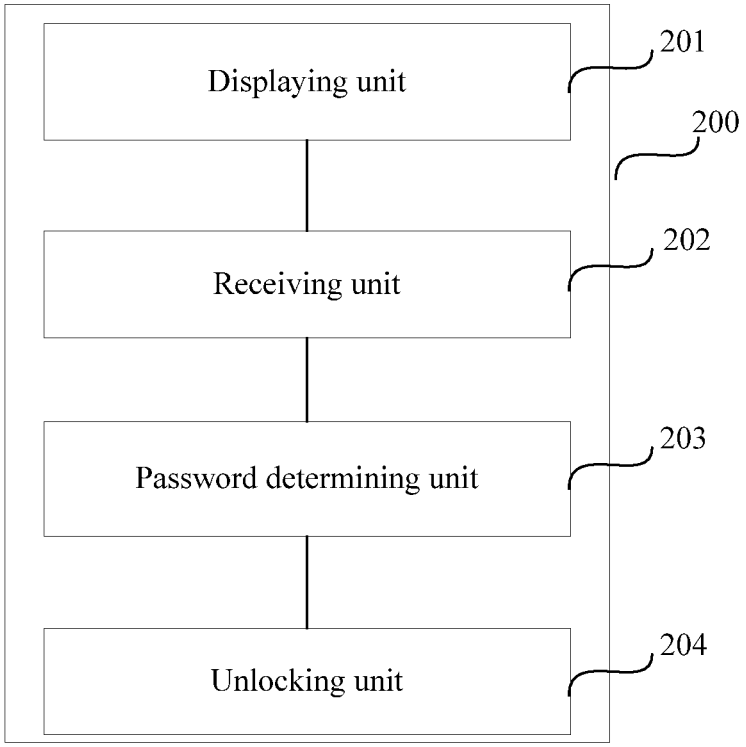
FIG. 8 is a schematic structural diagram of a screen unlocking apparatus according to an embodiment of the present invention.

Correspondingly, an embodiment of the present invention further provides a screen unlocking apparatus 200, as shown in FIG. 8, including: a displaying unit 201, configured to display a screen unlocking interface on a screen, where the screen unlocking interface includes a password unlocking area and a shortcut unlocking area; a receiving unit 202, configured to receive an unlocking pattern input by a user through the screen unlocking interface displayed by the displaying unit 201, where the unlocking pattern includes a password unlocking pattern input through the password unlocking area and a shortcut unlocking pattern input through the shortcut unlocking area; a password determining unit 203, configured to determine whether the password unlocking pattern which is input by the user and received by the receiving unit 202 is consistent with a preset password unlocking pattern; and an unlocking unit 204, configured to: if the password determining unit 203 determines that the password unlocking pattern input by the user is consistent with the preset password unlocking pattern, unlock the screen to enter a function interface corresponding to the shortcut unlocking pattern.

In the screen unlocking apparatus 200 provided in the embodiment of the present invention, the screen unlocking apparatus 200 has a screen unlocking interface, where the screen unlocking interface includes a password unlocking area and a shortcut unlocking area, that is, password unlocking and shortcut unlocking can be completed on one interface, which not only enhances the security of a touch device, but also helps the user to enter a specific function quickly, thereby reducing the waiting time of the user, increasing efficiency, and effectively improving user experience.

Specifically, in an embodiment of the present invention, on the screen unlocking interface displayed by the displaying unit 201, positional relationships between the password unlocking area and the shortcut unlocking area on the screen unlocking interface may include but not be limited to the following three types:

First, on the screen unlocking interface, the password unlocking area may be surrounded by the shortcut unlocking area.

Second, on the screen unlocking interface, the shortcut unlocking area may be surrounded by the password unlocking area.

Third, on the screen unlocking interface, the password unlocking area and the shortcut unlocking area may be adjacent in a vertical distribution. Definitely, the password unlocking area and the shortcut unlocking area may also be adjacent in a horizontal distribution. It should be noted that, in this distribution manner, of the password unlocking area and the shortcut unlocking area, which area is on the left and which area is on the right, or which area is upper and which area is lower are not limited in the present invention. In addition, in this manner, the foregoing two unlocking areas are not limited to an aligned arrangement, and the two areas may be unaligned. For example, the password unlocking area is located at a lower left corner of the screen, while the shortcut unlocking area is located at an upper right corner of the screen.

Optionally, in an embodiment of the present invention, the password unlocking area displayed by the displaying unit 201 may include at least two password unlocking buttons, and the user may input an unlocking password by pressing or sliding over these buttons according to a specific rule.

Specifically, in an embodiment of the present invention, the shortcut unlocking area displayed by the displaying unit 201 may include at least two shortcut function buttons, and the user may perform shortcut unlocking by selectively pressing or sliding over a shortcut function button, so that the touch device enters a function interface corresponding to the shortcut function button.

It should be noted that the password unlocking area displayed by the displaying unit 201 may include no password unlocking button and is a blank area only. The user may input, through the blank area, a character or a pattern as a password to perform unlocking.

In this way, the password unlocking and the shortcut unlocking are completed on one interface, which not only enhances security but also implements fast unlocking. In addition, the operation is convenient, which effectively improves user experience.

After the screen unlocking interface is displayed on the screen of the touch device, the user slides to input a pattern on the unlocking interface by using a finger or a stylus to perform password unlocking and shortcut unlocking.

In the embodiment of the present invention, the sequence of inputting patterns by the user is not limited. The user may first input a password unlocking pattern in the password unlocking area, and then input a shortcut unlocking pattern in the shortcut unlocking area, or the user may first input a shortcut unlocking pattern in the shortcut unlocking area, and then input a password unlocking pattern in the password unlocking area. That is, the receiving unit 202 may first receive the password unlocking pattern input by the user in the password unlocking area, and then receive the shortcut unlocking pattern which is input by the user in the shortcut unlocking area after the user inputs the password unlocking pattern in the password unlocking area; or, the receiving unit 202 may first receive the shortcut unlocking pattern input by the user in the shortcut unlocking area, and then receive the password unlocking pattern which is input by the user in the password unlocking area after the user inputs the shortcut unlocking pattern in the shortcut unlocking area.

Figure 9:
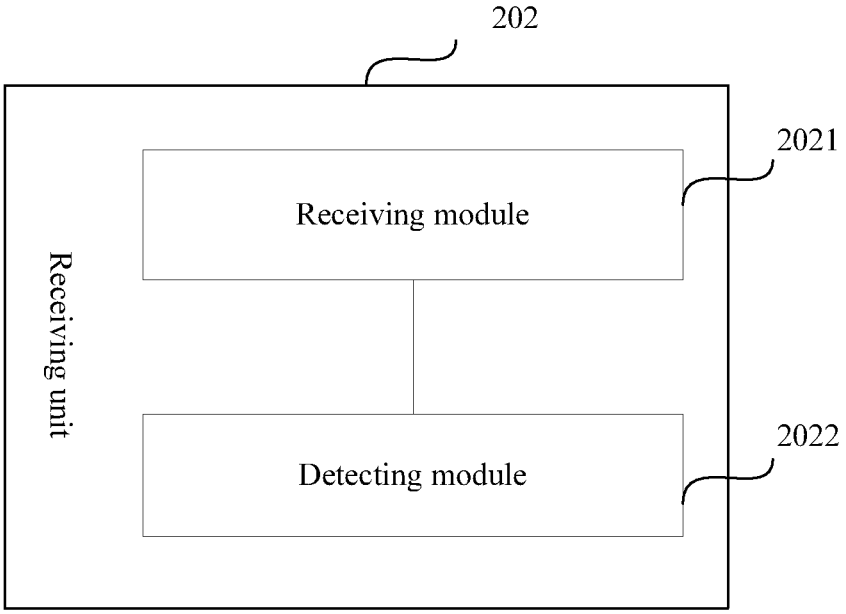
FIG. 9 is another schematic structural diagram of a screen unlocking apparatus according to an embodiment of the present invention.

In particular, as shown in FIG. 9, the receiving unit 202 specifically includes: a receiving module 2021, configured to receive an unlocking pattern input by the user by sliding in the password unlocking area; and a detecting module 2022, configured to detect, according to the unlocking pattern input by the user by sliding in the password unlocking area, a password unlocking pattern input by the user; where, the receiving module 2021 is further configured to receive an unlocking pattern which is input by the user by sliding in the shortcut unlocking area after the user slides away from the password unlocking area; and the detecting module 2022 is further configured to detect, according to the unlocking pattern input by the user in the shortcut unlocking area, a shortcut unlocking pattern input by the user.

In this case, the password determining unit 203 is specifically configured to determine whether the password unlocking pattern which is input by the user and detected by the detecting module 2022 is consistent with a preset password unlocking pattern. The unlocking unit 204 is specifically configured to unlock the screen to enter a function interface corresponding to the shortcut unlocking pattern detected by the detecting module 2022.

It may be understood that, when the user performs screen unlocking through an unlocking interface, that is, when the user slides to input an unlocking pattern by using a stylus or a finger, the user generally does not raise the finger or the stylus in this process, but after completing the sliding on one area of the password unlocking area and the shortcut unlocking area, the user slides away from the area, and then enters the other area of the foregoing two areas until the whole unlocking pattern is input by sliding, that is, no matter whether the user first inputs the password unlocking pattern or first inputs the shortcut unlocking pattern, the two patterns may be successive and uninterrupted, that is, in general cases, the password unlocking pattern and the shortcut unlocking pattern received by the receiving module 2021 are successive and uninterrupted.

It may be further understood that, in this step, in addition to the password unlocking pattern and the shortcut unlocking pattern, the unlocking pattern input by the user may further include other patterns, for example, lines connecting the password unlocking pattern and the shortcut unlocking pattern, and other patterns input freely by the user. Therefore, in this step, when the unlocking pattern input by the user is received, the detecting module 2022 needs to detect the password unlocking pattern and the shortcut unlocking pattern from the unlocking pattern input by the user.

In this way, the password unlocking performed in the password unlocking area and the shortcut unlocking performed in the shortcut unlocking area can be completed by the user on one interface only. The operation is convenient, which reduces the waiting time of the user, increases efficiency, and effectively improves user experience.

Figure 10:
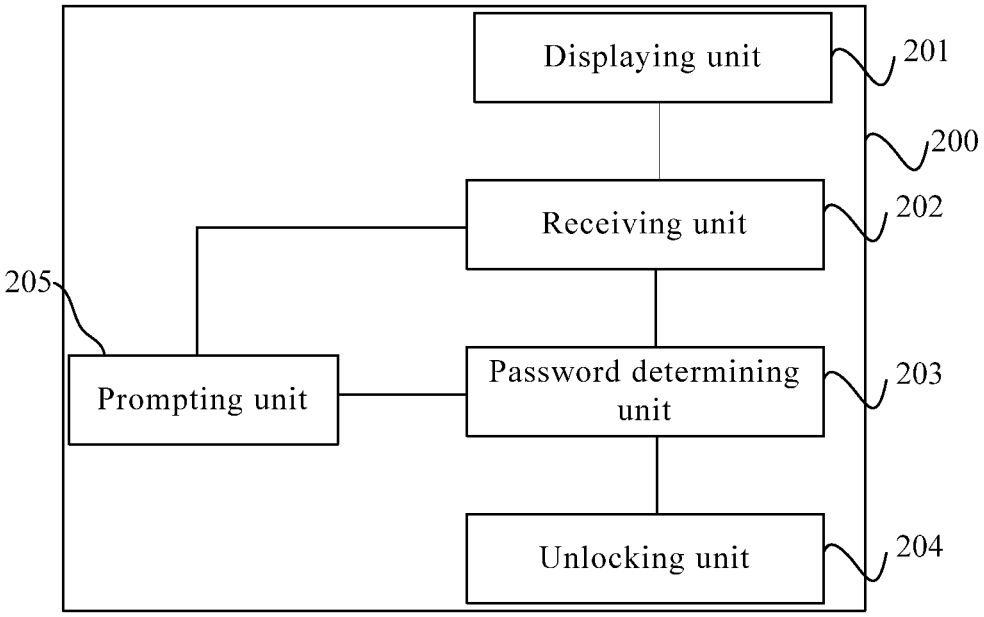
FIG. 10 is another schematic structural diagram of a screen unlocking apparatus according to an embodiment of the present invention.

Optionally, in an embodiment of the present invention, as shown in FIG. 10, the apparatus 200 further includes a prompting unit 205 configured to: if the password determining unit 203 determines that the password unlocking pattern input by the user is inconsistent with the preset password unlocking pattern, send a password incorrect prompt to the user.

Figure 11:
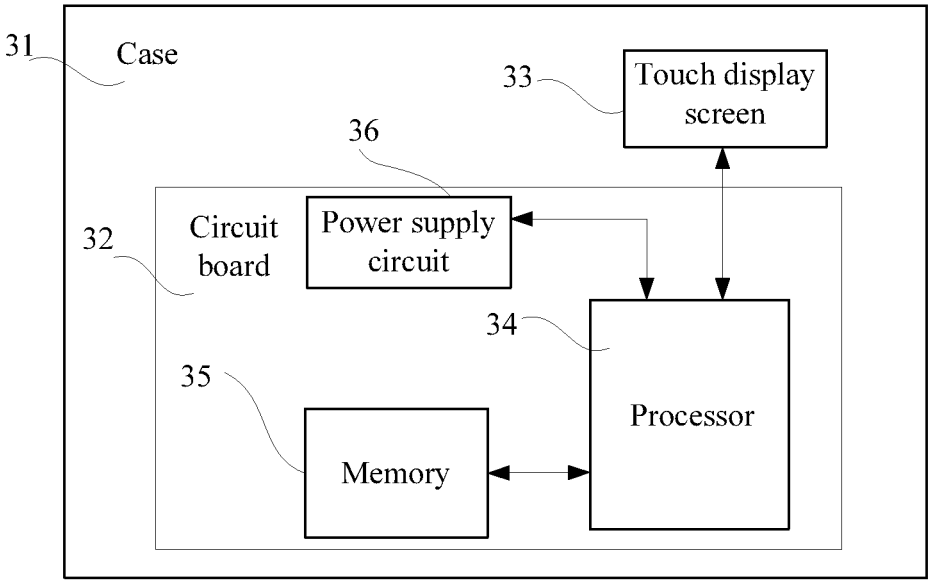
FIG. 11 is a schematic structural diagram of a touch device according to an embodiment of the present invention.

Correspondingly, an embodiment of the present invention further provides a touch device. As shown in FIG. 11, the touch device includes a case 31, a circuit board 32, a touch display screen 33, a processor 34, a memory 35, and a power supply circuit 36.

In the touch device: the touch display screen 33 is arranged on the case 31; the circuit board 32 is arranged in space enclosed by the case 31; the processor 34 and the memory 35 are disposed on the circuit board 32; the memory 35 is configured to store data; the power supply circuit 36 is configured to supply power to circuits or components of the touch device; and the processor 34 is configured to process data and is specifically configured to: display a screen unlocking interface on the touch display screen 33, where the screen unlocking interface includes a password unlocking area and a shortcut unlocking area; receive an unlocking pattern input by a user through the unlocking interface of the touch display screen 33, where the unlocking pattern includes a password unlocking pattern input through the password unlocking area and a shortcut unlocking pattern input through the shortcut unlocking area; determine whether the password unlocking pattern input by the user is consistent with a preset password unlocking pattern; and if the password unlocking pattern input by the user is consistent with the preset password unlocking pattern, unlock the screen to enter a function interface corresponding to the shortcut unlocking pattern.

Optionally, for a division of function executing units in the processor 34, reference may be made to the foregoing embodiment of the screen unlocking apparatus, which is not described herein again.

It may be understood that, in this embodiment, the memory 35 stores a program code corresponding to the functions performed by the processor 34; and when the processor 34 performs the foregoing functions, it reads the program code stored in the memory 35 to perform the functions corresponding to the read program code.

In the touch device provided in the embodiment of the present invention, a screen unlocking interface includes a password unlocking area and a shortcut unlocking area; after an unlocking pattern input by a user through the screen unlocking interface is received, it is determined whether a password unlocking pattern input by the user is consistent with a preset password unlocking pattern; and if the password unlocking pattern input by the user is consistent with the preset password unlocking pattern, the screen is unlocked to enter a function interface corresponding to a shortcut unlocking pattern. In this way, pattern password unlocking and shortcut unlocking can be completed on one interface, which not only enhances security of the touch device but also helps the user to enter a specific function quickly, thereby reducing the waiting time of the user, increasing efficiency, and effectively improving user experience.

Specifically, in an embodiment of the present invention, on the screen unlocking interface displayed by the touch display screen 33, positional relationships between the password unlocking area and the shortcut unlocking area on the screen unlocking interface may include but not be limited to the following three types:

First, on the screen unlocking interface, the password unlocking area may be surrounded by the shortcut unlocking area.

Second, on the screen unlocking interface, the shortcut unlocking area may be surrounded by the password unlocking area.

Third, on the screen unlocking interface, the password unlocking area and the shortcut unlocking area may be adjacent in a vertical distribution. Definitely, the password unlocking area and the shortcut unlocking area may also be adjacent in a horizontal distribution. It should be noted that, in this distribution manner, of the password unlocking area and the shortcut unlocking area, which area is on the left and which area is on the right, or which area is upper and which area is lower are not limited in the present invention. In addition, in this manner, the foregoing two unlocking areas are not limited to an aligned arrangement, and the two areas may be unaligned. For example, the password unlocking area is located at a lower left corner of the screen, while the shortcut unlocking area is located at an upper right corner of the screen.

Optionally, in an embodiment of the present invention, the password unlocking area displayed by the touch display screen 33 may include at least two password unlocking buttons, and the user may input an unlocking password by pressing or sliding over these buttons according to a specific rule.

Specifically, in an embodiment of the present invention, the shortcut unlocking area displayed by the touch display screen 33 may include at least two shortcut function buttons, and the user may perform shortcut unlocking by selectively pressing or sliding over a shortcut function button, so that the touch device enters a function interface corresponding to the shortcut function button.

It should be noted that the password unlocking area displayed by the touch display screen 33 may include no password button and is a blank area only. The user may input, through the blank area, a character or a pattern as a password to perform unlocking.

After the screen unlocking interface is displayed on the screen of the touch device, the user slides to input a pattern on the unlocking interface by using a finger or a stylus to perform password unlocking and shortcut unlocking.

For example, the touch device provided in the embodiment of the present invention may be any terminal device with a screen locking function, such as a handset, a tablet computer, or a personal digital assistant.

It should be noted that the embodiment of the present invention is applicable to a touch device with any operating system, for example, a touch device with an operating system such as Android, wp, or iOS, and may be implemented by making a modification to any operating system, which is not limited in the present invention.

It should be noted that the embodiments in this specification are described in a progressive manner. For the same or similar parts in the embodiments, reference may be made to the relevant parts. Each embodiment describes in emphasis what is different from other embodiments. In particular, since the apparatus embodiments are basically similar to the method embodiments, the descriptions of the apparatus embodiments are relatively simple. For details about related content, reference may be made to the descriptions of the method embodiments.

It should be noted that the foregoing apparatus embodiments are merely exemplary. The units that are described as separate parts may be physically separate or not separate. The parts that are displayed as the units may be physical units or not be physical units. That is, the parts may be located in one place or distributed in multiple network units. Some or all of the modules may be selected according to the actual need to achieve the objectives of the technical solutions provided in embodiments of the present invention. In addition, in the accompanying drawings of the apparatus embodiments provided by the present invention, the connection relations between the modules indicate that the modules have communication connections, which may be specifically implemented as one or more communication buses or signal cables. A person of ordinary skill in the art can understand and implement the present invention without creative efforts.

According to the description about the embodiments, a person skilled in the art is fully aware that the present invention may be implemented by using software plus necessary universal hardware, and definitely may also be implemented by using such dedicated hardware as an application specific integrated circuit, a dedicated CPU, a dedicated memory, and dedicated parts and components. In general, all functions that can be performed by a computer program can be easily implemented by using corresponding hardware. In addition, specific hardware structures used to implement the same function may be varied, for example, analog circuit, digital circuit, dedicated circuit, or the like. However, in most cases, the present invention is preferably implemented by using the software programs. Based on such an understanding, the technical solutions of the present invention or the part contributing to the prior art may be embodied by a software product. The software product may be stored in a readable storage medium, for example, a floppy disk, a universal serial bus (USB) drive, a removable hard disk, a read-only memory (ROM), a random access memory (RAM), a magnetic disk, or a compact disk of a computer, and include several instructions used to enable a computer device (for example, a personal computer, a server, or a network device, or the like) to perform the methods provided by the embodiments of the present invention.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A screen unlocking method, comprising:

displaying a screen unlocking interface on a screen, wherein the screen unlocking interface comprises a password unlocking area and a shortcut unlocking area;

receiving an unlocking pattern input by a user through the screen unlocking interface, wherein the unlocking pattern comprises a password unlocking pattern input through the password unlocking area and a shortcut unlocking pattern input through the shortcut unlocking area, and wherein receiving the unlocking pattern comprises:

receiving the password unlocking pattern input by the user in the password unlocking area; and receiving the shortcut unlocking pattern input by the user in the shortcut unlocking area;

determining whether the password unlocking pattern is consistent with a preset password unlocking pattern; and unlocking the screen to enter a function interface when the password unlocking pattern is consistent with the preset password unlocking pattern, wherein the function interface that is entered is determined by the shortcut unlocking pattern, and wherein the shortcut unlocking pattern is input in the shortcut unlocking area after the password unlocking pattern is input in the password unlocking area.

2. A screen unlocking method, comprising:

displaying a screen unlocking interface on a screen, wherein the screen unlocking interface comprises a password unlocking area and a shortcut unlocking area;

receiving an unlocking pattern input by a user through the screen unlocking interface, wherein the unlocking pattern comprises a password unlocking pattern input through the password unlocking area and a shortcut unlocking pattern input through the shortcut unlocking area, and wherein receiving the unlocking pattern comprises:

receiving the shortcut unlocking pattern input by the user in the shortcut unlocking area; and receiving the password unlocking pattern input by the user in the password unlocking area;

determining whether the password unlocking pattern is consistent with a preset password unlocking pattern; and unlocking the screen to enter a function interface when the password unlocking pattern is consistent with the preset password unlocking pattern, wherein the function interface that is entered is determined by the shortcut unlocking pattern, and wherein the password unlocking pattern is input in the password unlocking area after the shortcut unlocking pattern is input in the shortcut unlocking area.

3. A screen unlocking method, comprising:

displaying a screen unlocking interface on a screen, wherein the screen unlocking interface comprises a password unlocking area and a shortcut unlocking area;

receiving an unlocking pattern input by a user through the screen unlocking interface, wherein the unlocking pattern comprises a password unlocking pattern input through the password unlocking area and a shortcut unlocking pattern input through the shortcut unlocking area, and wherein receiving the unlocking pattern comprises:

receiving the unlocking pattern input by the user by sliding in the password unlocking area;

detecting, according to the unlocking pattern input, the password unlocking pattern;

receiving the unlocking pattern in the shortcut unlocking area after the user slides away from the password unlocking area; and detecting, according to the unlocking pattern, the shortcut unlocking pattern input by the user;

determining whether the password unlocking pattern is consistent with a preset password unlocking pattern, wherein determining whether the password unlocking pattern input by the user is consistent with the preset password unlocking pattern comprises determining whether the detected password unlocking pattern is consistent with the preset password unlocking pattern; and unlocking the screen to enter a function interface when the password unlocking pattern is consistent with the preset password unlocking pattern, wherein the function interface that is entered is determined by the shortcut unlocking pattern, and wherein unlocking the screen to enter the function interface corresponding to the shortcut unlocking pattern comprises unlocking the screen to enter the function interface corresponding to the detected shortcut unlocking pattern.

4. A screen unlocking apparatus, comprising:

a display configured to display a screen unlocking interface on a screen, wherein the screen unlocking interface comprises a password unlocking area and a shortcut unlocking area;

a processor coupled to the display and configured to:

receive an unlocking pattern input from a user through the screen unlocking interface displayed by the display, wherein the unlocking pattern comprises a password unlocking pattern input through the password unlocking area and a shortcut unlocking pattern input through the shortcut unlocking area, and wherein in being configured to receive the unlocking pattern input from the user, the processor is configured to:

receive the password unlocking pattern input by the user in the password unlocking area; and receive the shortcut unlocking pattern input by the user in the shortcut unlocking area;

determine whether the password unlocking pattern which is input by the user and received by the receiver is consistent with a preset password unlocking pattern; and unlock the screen to enter a function interface when the password unlocking pattern input by the user is consistent with the preset password unlocking pattern, wherein the function interface that is entered is determined by the shortcut unlocking pattern, arid wherein the shortcut unlocking pattern is input in the shortcut unlocking area after the password unlocking pattern is input in the password unlocking area.

5. A screen unlocking apparatus, comprising:

a display configured to display a screen unlocking interface on a screen, wherein the screen unlocking interface comprises a password unlocking area and a shortcut unlocking area;

a processor coupled to the display and configured to:

receive an unlocking pattern input from a user through the screen unlocking interface displayed by the display, wherein the unlocking pattern comprises a password unlocking pattern input through the password unlocking area and a shortcut unlocking pattern input through the shortcut unlocking area, and wherein in being configured to receive the unlocking pattern input from the user, the processor is configured to receive the shortcut unlocking pattern input by the user in the shortcut unlocking area; and receive the password unlocking pattern input by the user in the password unlocking area, wherein the password unlocking pattern is input in the password unlocking area after the shortcut unlocking pattern is input in the shortcut unlocking area;

determine whether the password unlocking pattern which is input by the user and received by the receiver is consistent with the preset password unlocking pattern; and unlock the screen to enter a function interface when the password unlocking pattern input by the user is consistent with the preset password unlocking pattern, wherein the function interface that is entered is determined by the shortcut unlocking pattern.

6. A screen unlocking apparatus, comprising:

a display configured to display a screen unlocking interface on a screen, wherein the screen unlocking interface comprises a password unlocking area and a shortcut unlocking area;

a processor coupled to the display and configured to:

receive an unlocking pattern input from a user through the screen unlocking interface displayed by the display, wherein the unlocking pattern comprises a password unlocking pattern input through the password unlocking area and a shortcut unlocking pattern input through the shortcut unlocking area, and wherein in being configured to receive the unlocking pattern input from the user, the processor is configured to:

receive the unlocking pattern input by the user by sliding in the password unlocking area;

detect, according to the unlocking pattern, the password unlocking pattern;

receive the unlocking pattern in the shortcut unlocking area after the user slides away from the password unlocking area; and detect, according to the unlocking pattern input, the shortcut unlocking pattern input by the user;

determine whether the password unlocking pattern which is input by the user and received by the receiver is consistent with a preset password unlocking pattern, wherein in being configured to determine whether the password unlocking pattern which is input by the user and received by the receiver is consistent with a preset password unlocking pattern, the processor is configured to determine whether the password unlocking pattern is consistent with the preset password unlocking pattern; and unlock the screen to enter a function interface when the password unlocking pattern input by the user is consistent with the preset password unlocking pattern, wherein the function interface that is entered is determined by the shortcut unlocking pattern, and wherein, in being configured to unlock the screen, the processor is configured to unlock the screen to enter the function interface corresponding to the shortcut unlocking pattern.

* * * * *